US009388644B2

(12) United States Patent
Wiedenmann

(10) Patent No.: US 9,388,644 B2
(45) Date of Patent: Jul. 12, 2016

(54) DRILLING DEVICE AND DRILLING METHOD

(71) Applicant: BAUER Spezialtiefbau GmbH, Schrobenhausen (DE)

(72) Inventor: Ulli Wiedenmann, Schrobenhausen (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 99 days.

(21) Appl. No.: 14/320,789

(22) Filed: Jul. 1, 2014

(65) Prior Publication Data

US 2015/0008040 A1 Jan. 8, 2015

(30) Foreign Application Priority Data

Jul. 3, 2013 (EP) ..... 13174836

(51) Int. Cl.

| | |
|---|---|
| ***E21B 17/04*** | (2006.01) |
| ***E21B 17/05*** | (2006.01) |
| ***E21B 19/02*** | (2006.01) |
| ***E21B 7/00*** | (2006.01) |
| ***E21B 17/02*** | (2006.01) |

(52) U.S. Cl.

CPC . *E21B 17/04* (2013.01); *E21B 7/00* (2013.01); *E21B 17/02* (2013.01); *E21B 17/05* (2013.01); *E21B 19/02* (2013.01)

(58) Field of Classification Search

CPC ..... E21B 17/05; E21B 17/04; E21B 19/02
See application file for complete search history.

(56) References Cited

U.S. PATENT DOCUMENTS

| | | | | |
|---|---|---|---|---|
| 1,398,551 | A * | 11/1921 | Hanson | E21B 3/02 173/197 |
| 3,426,855 | A * | 2/1969 | Koot | E21B 3/02 173/197 |
| 3,766,991 | A * | 10/1973 | Brown | E21B 19/20 173/164 |
| 3,774,697 | A * | 11/1973 | Brown | E21B 21/12 173/164 |
| 5,501,287 | A | 3/1996 | Loeser | |
| 8,807,208 | B1 * | 8/2014 | Keast | E21B 19/06 166/75.11 |
| 2004/0108144 | A1 | 6/2004 | Volkel | |
| 2009/0266616 | A1 | 10/2009 | Finkenzeller | |
| 2011/0011646 | A1 | 1/2011 | Giroux et al. | |
| 2011/0048805 | A1 | 3/2011 | Bauer | |

FOREIGN PATENT DOCUMENTS

| | | |
|---|---|---|
| EP | 0645519 A1 | 3/1995 |
| EP | 2295645 A1 | 3/2011 |

OTHER PUBLICATIONS

European Search Report; EP13174836; Jan. 7, 2014.

* cited by examiner

*Primary Examiner* — Shane Bomar
(74) *Attorney, Agent, or Firm* — Studebaker & Brackett PC

(57) ABSTRACT

A drilling device and method with a drill rod which can be driven in a rotating manner and has an internal line, a support rope, a rotary joint between the drill rod and the support rope and has a holding member which is in connection with the support rope and a rotary member which is in connection with the rotatable drill rod, a line and a rotary feed-through which is designed for the passage of fluid and/or data between the line and the internal line of the drill rod, wherein the rotary feed-through has a rotor connected to the drill rod and a non-rotating stator, to which the line is attached. Provision is made for the support rope to be designed in a torsion-proof manner and for a rigid connecting element to be arranged as a torque support between the stator of the rotary feed-through and the torsion-proof support rope.

9 Claims, 1 Drawing Sheet

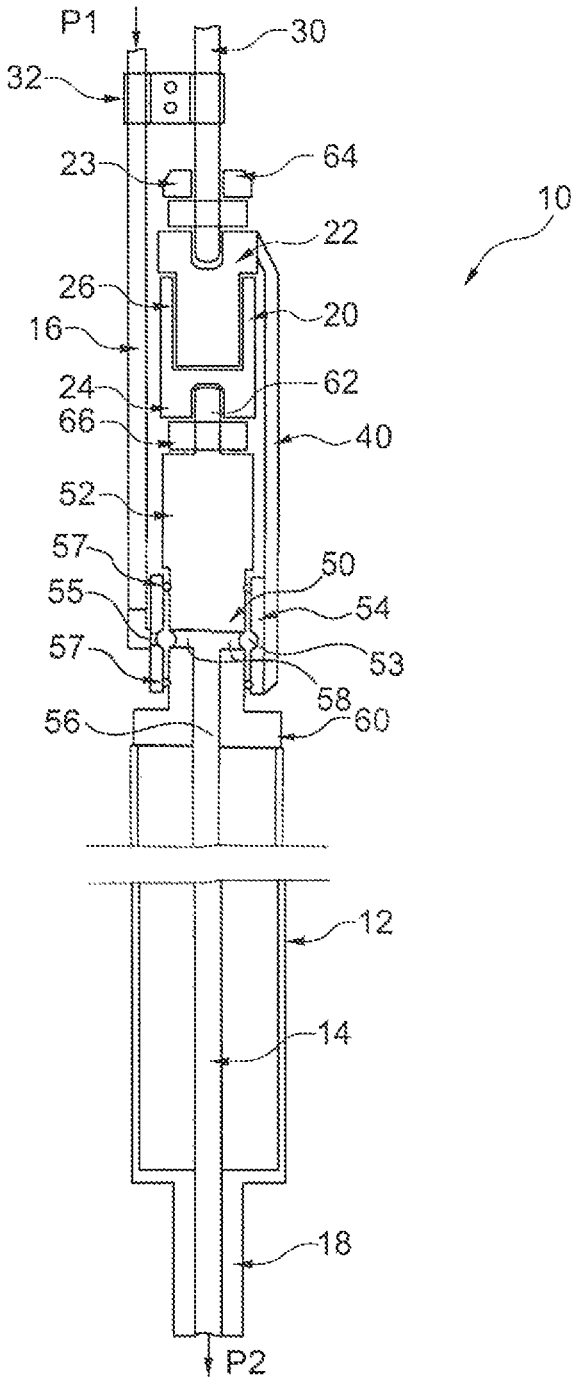
P1
30
32
23
64
10
22
26
20
16
24
62
66
40
52
57
50
55
54
57
53
58
56
60
12
14
18
P2

DRILLING DEVICE AND DRILLING METHOD

The invention relates to a drilling device with a drill rod which can be driven in a rotating manner and has an internal line, a support rope, a rotary joint which is arranged between the drill rod and the support rope and has a holding member which is in connection with the support rope and a rotary member which is in connection with the rotatable drill rod, a line and a rotary feed-through which is designed for the passage of fluid and/or data between the line and the internal line of the drill rod, wherein the rotary feed-through has a rotor connected to the drill rod and a non-rotating stator, to which the fluid line is attached, in accordance with the preamble of claim 1.

The invention further relates to a drilling method, in which a drill rod having an internal hollow space is driven in a rotating manner, the drill rod is suspended on a support rope and supported thereon in a rotating manner via a rotary joint and by means of a rotary feed-through fluid and/or data are passed between the internal line of the drill rod and a line, wherein the rotary feed-through has a rotor connected to the drill rod and a stator connected to the line.

For certain drilling methods it is necessary to introduce fluid via an internal hollow space of the tubular drill rod into the borehole or to discharge it from the said borehole. For the supply or discharge of a fluid a rotary feed-through for a fluid, which is also referred to as a flush head, is arranged at the upper end of the drill rod. The rotary feed-through has a rotor which is firmly connected to the rotating drill rod and usually supported in a sleeve serving as a stator. On the stator the external line is attached in order to supply e.g. flushing liquid from outside to the borehole or to discharge flushing liquid containing drill cuttings from the drill rod towards the outside. To prevent the external line from being twisted by the rotating drill rod a torque support is provided for the stator. The torque support ensures that the stator is stationary relative to the rotating rotor.

Usually, the torque support connects the stator in a torque-proof manner to the drilling apparatus. From EP 0 645 519 A1 it is known that the stator of the rotary feed-through is firmly coupled to the carriage of the drilling apparatus via a sleeve-shaped rotation protection means and a bar-shaped torque support in order to thereby ensure support of the torque. However, a torque support of such type requires an appropriate amount of constructional space above the drill rod so that operations carried out in this area may be obstructed. In addition, a synchronous movement with the carriage of the drilling apparatus is possible.

Furthermore, from EP 2 295 645 A1 it is known that a twisting of the stator of a rotary feed-through is compensated by a separate rotary drive. For this purpose, a control is required that establishes a twisting of the position and controls a corresponding counter-rotation. As a result, the torque support can be dispensed with. This solution involves an additional amount of time and effort concerning the rotary drive and the control.

Moreover, it is known that data or electrical power is transmitted from an external line to the rotating drill rod by means of a rotary feed-through with sliding contacts.

The invention is based on the object to provide a drilling device, in which an efficient and reliable torque support of the rotary feed-through is ensured.

The drilling device according to the invention is characterized in that the support rope is designed in a torsion-proof manner and that a rigid connecting element is arranged as a torque support between the stator of the rotary feed-through and the torsion-proof support rope.

A fundamental idea of the invention resides in the fact that the torque present on the stator of the rotary feed-through is not supported with respect to a rigid component of the drilling device, such as the mast, the drilling apparatus carriage or the drilling apparatus, but instead on the flexible support rope. The invention is based on the finding that the support rope, in order to be wound up or unwound from a winch drum, only has to be flexible in the axial longitudinal rope direction. According to the invention, however, the support rope is designed in a torsion-proof manner in a circumferential direction with respect to the longitudinal rope axis. In this way, the torque on the stator can be supported directly with respect to the support rope and can be received by the latter. The rotary feed-through with the stator is arranged in spatial proximity to the support rope at its lower end. As a result, a rigid connecting element serving as a torque support can be designed in a relatively small dimension. Moreover, the rotary feed-through follows the lifting movement of the support rope so that this torque support does not constitute a substantial obstacle during operation of the drilling device or during implementation of the drilling method. The torque support can be attached directly to the support rope or to a part suspended thereon in a torque-proof manner.

By preference, the support rope is a steel rope which is of torsion-proof or warp-resistant design. Within the meaning of the invention the support rope can also be a chain consisting of chain links that are connected to each other in such a way that these are capable of being wound up whilst being torsion-proof or warp-resistant.

To form a rotary feed-through the stator and the rotor can be of any chosen design. According to the invention a particularly robust arrangement is achieved in that the stator of the rotary feed-through is designed in a sleeve-shaped manner and that on the exterior of the sleeve-shaped stator the line is attached. The external line preferably runs parallel to the support rope in the upward direction over a mast head and is arranged on a rotatable line drum. To this for example a fluid reservoir is attached accordingly. Within the meaning of the invention the fluid concerned can generally be a medium, in particular flushing liquid, a hardenable suspension, hydraulic fluid or compressed air but also electrical power, which is supplied from outside via the line to the borehole. The fluid line can also serve as a discharge line to discharge e.g. flushing liquid containing drill cuttings via the interior of the drill rod and the rotary feed-through towards the outside to a collecting container. For the transmission of data or electrical power the rotary feed-through can also have a contact ring, against which sliding contacts rest as a counter-part.

Furthermore, a preferred embodiment of the invention resides in the fact that the rotor of the rotary feed-through is designed in a shaft-shaped manner with a central duct which is connected to the line via at least one radial duct. By preference, the shaft-shaped rotor is supported in a rotatable manner in the sleeve-shaped stator, wherein an annular duct running in the circumferential direction is designed between rotor and stator. Via a radial access duct liquid can be guided for example from the fluid line into this annular duct. Via the annular duct the fluid can be guided via one or several radial ducts to the central duct of the rotor. The central duct is in line connection with the inner duct-like hollow space of the drill rod that constitutes the internal line. In this way, fluid can be guided from outside via the drill rod to a ground-removing drilling tool located at the lower end of the drill rod in order to cool the said tool and flush out removed ground material. Basically, it is also possible to introduce a hardenable suspension into the borehole for the production of a foundation element. In the ducts data/electricity cables can be provided.

According to an embodiment of the invention it is advantageous for the rotor to have an attachment section for fastening the drill rod in a torque-proof manner. The attachment section can be a flange in particular, through which the drill rod can be connected in a releasable manner to the rotor.

Basically, it is possible that the rotor is designed integrally with the rotary member of the rotary joint. For the use of standard components, however, it is preferred that in its upper area the rotor has a connecting section for connection to the rotary joint. Hence, use can be made of a standard rotary joint and a standard rotary feed-through, in which case the rotor is connected in a releasable manner to the rotary joint via a connecting means. The connecting section can have one or several locking bolts or fastening screws in particular.

BRIEF DESCRIPTION OF THE DRAWINGS

FIG. 1 is a schematic illustration of a drilling apparatus embodying the teachings of the present invention.

Another embodiment of the invention resides in the fact that the holding member of the rotary joint is designed in a bolt-shaped manner and has a fastening section for the torque-proof connection to the support rope. For instance a connecting strap or a lug can be arranged at the end of the support rope. By way of a transversely directed connecting bolt the support rope can thus be connected via a connecting trestle with two bolt holes to the holding member. However, provision can also be made for other types of connecting means, in which case a torsion-proof connection must be ensured between the holding member and the support rope. This applies in particular if the torque support according to the invention is not connected directly to the support rope but to the holding member in a lower area thereof.

According to the invention a preferred embodiment furthermore resides in the fact that the rotary member of the rotary joint has a sleeve-shaped receiving section, in which the bolt-shaped holding member is supported in a rotatable manner. As a result, an especially robust rotary joint is obtained. In principle, however, the holding member can also be of sleeve-shaped design and the rotary member of bolt-shaped design. The holding member preferably has a section, on which the rigid torque support can be fastened.

According to the invention an especially useful arrangement results from the fact that the line extends upwards approximately parallel to the drilling axis and to the support rope and that the line is connected to the support rope via at least one connecting clamp. Basically, it is possible that the line between the rotary feed-through and the connecting clamp is designed as a rigid pipe or a torsion-proof line, and thereby constitutes in itself the torque support between the rotary feed-through and the support rope. The fluid line which extends further upwards from the connecting clamp can then be designed in the usual way as a conventional hose line or a data/electric cable.

Within the meaning of the invention the drilling device can be understood as solely residing in the drill rod and the drill rod suspension. In a preferred embodiment provision is made in that a drill drive is provided for driving the drill rod in a rotating manner and that the drill drive has an annular drive wheel, through which the drill rod extends and which is in torque-transmitting connection with drive elements on the exterior of the drill rod. The drill rod can be designed, in particular, as a simple or telescopic Kelly drill rod, on the external sides of which rib-like drive strips are provided. Thereby, the drill drive is arranged such that it is situated below the rotary feed-through at the upper end of the drill rod.

Furthermore, according to the invention a drilling apparatus with a mast is provided, over which a support rope of a drilling device is guided and along which a drill rod of the drilling device is driven in a rotatable manner and is vertically displaceable. This drilling apparatus is characterized in accordance with the invention in that the previously described drilling device is arranged. As a mast the drilling apparatus can have a leader or fixed leader or a pivotable extension arm. Drilling apparatuses of such type can be employed, in particular, for earth or rock drilling and in particular for producing pile-shaped foundation elements.

With regard to the method the object stated at the beginning is achieved in accordance with the invention in that the support rope is designed in a torsion-proof manner and that a torque present on the stator of the rotary feed-through is supported by means of a rigid connecting element with respect to the torsion-proof support rope. The drilling method according to the invention is preferably carried out with the previously described drilling device, whereby the advantages set out beforehand are obtained. With the drilling method according to the invention boreholes for foundation elements can be produced.

In the following the invention is described further by way of a preferred embodiment shown schematically in the accompanying drawing.

The illustrated drilling device 10 according to the invention comprises a bar-shaped drill rod 12, at the lower end of which a schematically depicted tool attachment 18 is arranged, on which a drilling tool for removing ground material can be mounted. The drill rod 12 has a central duct-like hollow space as an internal line 14. In the illustrated embodiment the said hollow space is designed for the supply of a fluid as per arrow P1 through the external line 16 to the lower end of the drill rod 12. There the fluid emerges as per arrow P2.

The drill rod 12 is, as is known, driven in a rotating manner by a drill drive not shown here. For this purpose, the drill rod 12 projects through the annular drill drive, in which case a torque can be transmitted from the drill drive via an annular drive wheel to drive strips, not illustrated here, on the exterior of the drill rod 12.

Furthermore, the drill rod 12 is suspended in a known manner by means of a support rope 30 on a mast, not shown here. To prevent a rotational movement of the rotationally driven drill rod 12 from being transmitted to the line 16, also referred to as an external line, and to the support rope 30 provision is made in accordance with the invention for a rotary feed-through 50 and a rotary joint 20 to be arranged above the drill rod 12.

The support rope 30 has in a known manner a lug-shaped connecting strap at its lower end. The connecting strap of the support rope 30 projects into a receiving opening of a shaft-shaped holding member 22 of the rotary joint 20. By way of a transversely directed locking bolt 23 the support rope 30 is connected in a torque-proof manner in relation to the drilling axis to the shaft-shaped holding member 22 of the rotary joint 20. The shaft-shaped holding member 22 is supported in a rotating manner, yet fixed in the axial direction, in a sleeve-shaped receiving section 26 of a rotary member 24 of the rotary joint 20. In this way, the rotary member 24 can be rotated relative to the stationary holding member 22 so that the rotary joint 20 prevents a transmission of a torque from the drill rod 12 to the holding member 22.

At the lower end of the holding member 22 a rotor 52 of the rotary feed-through 50 is attached in a torque-proof and releasable manner by means of a latch bolt 66. At its opposite lower end the shaft-shaped rotor 52 has a flange-shaped attachment section 60, on which the drill rod 12 is mounted in a releasable manner.

In its lower half the rotor 52 has a central duct 56 which is in fluid connection with the duct-like internal line 14 of the drill rod 12. At its upper end the central duct 56 leads into two outwardly directed radial ducts 58 which, in turn, lead into an annular duct 53 arranged on the outer circumference. The annular duct 53 is formed between the rotor 52 and a surrounding sleeve-shaped stator 54. On the outer circumference of the sleeve-shaped stator 54 of the rotary feed-through 50 the line 16 is attached via an attachment piece. Via a passage opening 55 fluid can flow from the line 16 into the annular duct 53 and thus via the radial ducts 58 and the central duct 56 into the duct-like hollow space in the drill rod 12.

The shaft-shaped rotor 52 is supported in a rotatable manner in the sleeve-shaped stator 54, wherein the intermediate space between both parts is sealed axially by sealing rings 57. To prevent the external line 16 from rotating jointly with the drill rod 12 it is necessary that the sleeve-shaped stator 54 is supported with respect to a torque-proof part. To this end, a bar-shaped connecting element 40 is provided as a torque support which is firmly mounted on the one hand on the exterior of the stator 54 and on the other hand on the lower end of the support rope 30, namely in the illustrated embodiment on the holding member 22 that is connected in a torque-proof manner to the support rope 30.

In accordance with the invention the support rope 30 is designed in a sufficiently torsion-proof or warp-resistant manner in the circumferential direction of the drilling axis and therefore of the rotational drilling movement. Hence, via the bar-shaped connecting element 40 the torque acting on the stator 54 can be supported with respect to the torque-proof support rope 30 and the holding member 22 connected thereto. The torsion-proof support rope 30 can then transfer the transmitted torque via the mast head to the mast and the drilling apparatus. Thus, the stator 54 is stationary relative to the rotating drill rod 12 and to the rotating rotor 42 as well as the rotating rotary member 24 of the rotary joint 20. In this way, a co-rotation and warping of the line 16 is reliably prevented, without requiring the provision of a direct cumbersome connection between the rotary feed-through 50 and the drilling apparatus.

The invention claimed is:

1. Drilling device with a drill rod which can be driven in a rotating manner and has an internal line, a support rope, a rotary joint which is arranged between the drill rod and the support rope and has a holding member which is in connection with the support rope and a rotary member which is in connection with the rotatable drill rod, a line for a fluid and/or data, and a rotary feed-through which is designed for the passage of fluid and/or data between the line and the internal line of the drill rod, wherein the rotary feed-through has a rotor connected to the drill rod and a non-rotating stator, to which the fluid line is attached, wherein the support rope is designed in a torsion-proof manner and a rigid connecting element is arranged as a torque support between the stator of the rotary feed-through and the torsion-proof support rope such that the rigid connecting element is firmly connected to both the stator and the support rope.

2. Drilling device according to claim 1, wherein the stator of the rotary feed-through is designed in a sleeve-shaped manner and on the exterior of the sleeve-shaped stator the line is attached.

3. Drilling device according to claim 1, wherein the rotor of the rotary feed-through is designed in a shaft-shaped manner with a central duct which is connected to the line via at least one radial duct.

4. Drilling device according to claim 1, wherein the rotor has an attachment section for fastening the drill rod in a torque-proof manner.

5. Drilling device according to claim 1, wherein in its upper area the rotor has a connecting section for connection to the rotary joint.

6. Drilling device according to claim 1, wherein the holding member of the rotary joint is designed in a bolt-shaped manner and has a fastening section for the torque-proof connection to the support rope.

7. Drilling device according to claim 6, wherein the rotary member of the rotary joint has a sleeve-shaped receiving section, in which the bolt-shaped holding member is supported in a rotatable manner.

8. Drilling device according to claim 1, wherein the line extends upwards approximately parallel to the drilling axis and to the support rope and the line is connected to the support rope via at least one connecting clamp.

9. Drilling method, in which a drill rod having an internal line is driven in a rotating manner, the drill rod is suspended on a support rope and supported thereon in a rotating manner via a rotary joint and by means of a rotary feed-through fluid and/or data are passed between the internal line of the drill rod and a line, wherein the rotary feed-through has a rotor connected to the drill rod and a stator connected to the line, wherein the support rope is designed in a torsion-proof manner and a torque present on the stator of the rotary feed-through is supported by means of a rigid connecting element being firmly connected to both the torsion-proof support rope and the stator.

* * * * *